US006613057B1

(12) United States Patent
Obermann

(10) Patent No.: US 6,613,057 B1
(45) Date of Patent: Sep. 2, 2003

(54) EPILATING DEVICE WITH PINCHING ELEMENTS HAVING A DELAYING ELEMENT

(75) Inventor: Wolfgang Johannes Obermann, Bruck/Mur (AT)

(73) Assignee: Koninklijke Philips Electronics, N.V., Eindhoven (NL)

( * ) Notice: Subject to any disclaimer, the term of this patent is extended or adjusted under 35 U.S.C. 154(b) by 343 days.

(21) Appl. No.: 09/703,420

(22) Filed: Nov. 1, 2000

(30) Foreign Application Priority Data

Nov. 1, 1999 (EP) ..... 99203587

(51) Int. Cl.[7] ..... A61B 17/50
(52) U.S. Cl. ..... 606/133; 606/131
(58) Field of Search ..... 606/131, 133, 606/42

(56) References Cited

U.S. PATENT DOCUMENTS 6,045,559 A * 4/2000 Sueyoshi et al. ..... 606/133
6,083,233 A * 7/2000 Kreutz et al. ..... 606/133
6,123,713 A * 9/2000 Yiu et al. ..... 606/133

FOREIGN PATENT DOCUMENTS

EP 0532106 A1 3/1993

* cited by examiner

*Primary Examiner*—Linda C. M. Dvorak
*Assistant Examiner*—David M. Ruddy
(74) *Attorney, Agent, or Firm*—Ernestine C. Barlett

(57) ABSTRACT

The invention relates to an epilating device which comprises a housing (1) with an opening (5), after which a rotatable drive shaft (7) is arranged extending parallel to said opening and carrying a series of cooperating pinching elements (9) coupled to the drive shaft in a rotational direction (R). During rotation of the drive shaft, pairs of adjacent pinching elements are periodically pivoted with respect to each other, under the influence of a compression member (81), from a catching position, in which a distance is present between the pinching elements near the opening, into a pinching position, in which the pinching elements contact each other near said opening. At least one of the pinching elements of each pair comprises a delaying element (49, 65) for delaying or postponing a pivotal motion of the pinching elements towards the pinching position.

Figure 1:
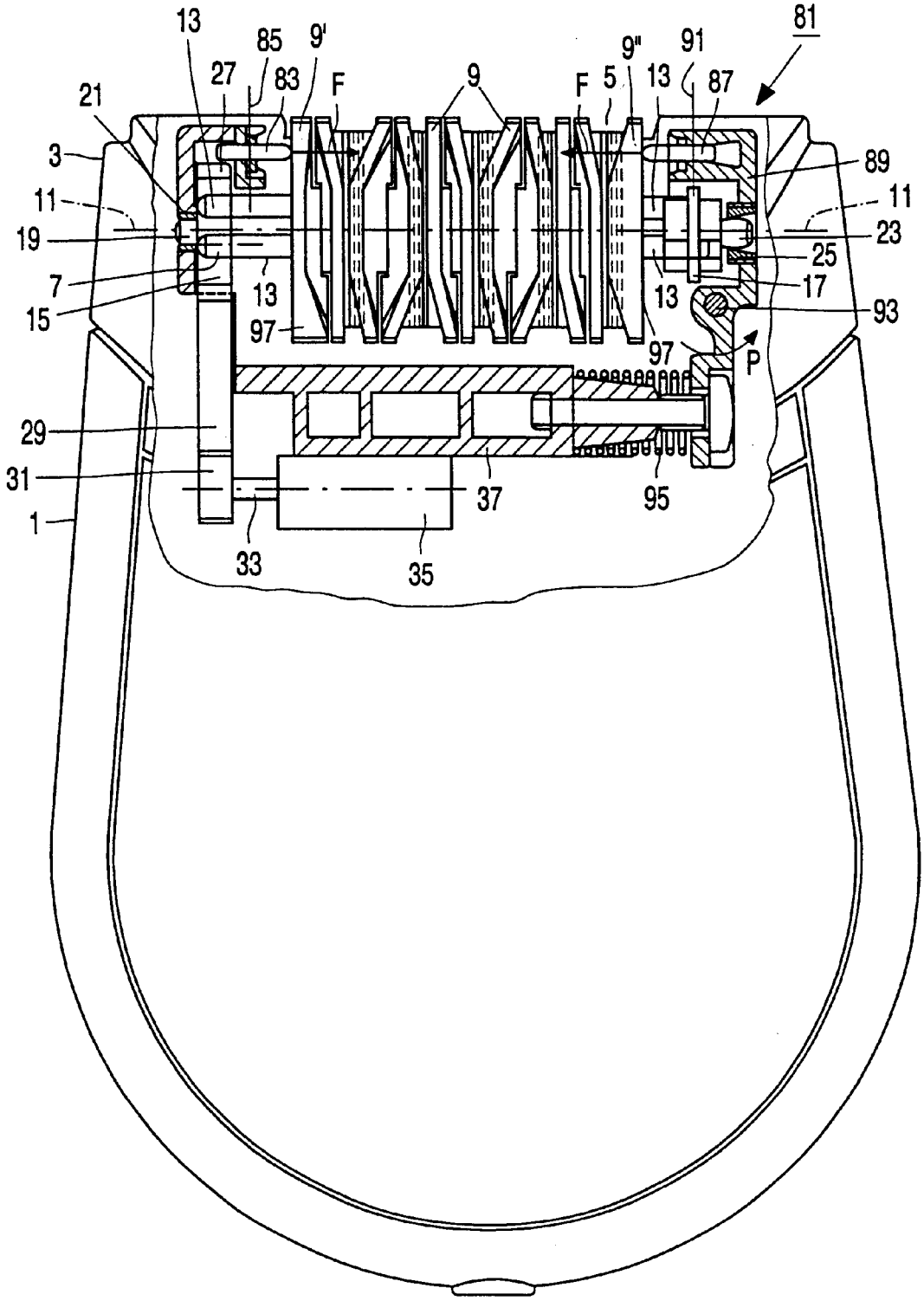

According to the invention, the delaying element comprises at least a first and a second contact position (141, 143) for the pair of cooperating pinching elements, said contact positions defining a pivot axis (53) about which the two pinching elements are pivotable with respect to each other. The pivot axis is arranged at a distance from a central point (45) of the pinching elements and between said central point and a pinching surface (57, 71) of the pinching elements. In this manner, a relatively strong delaying effect of the delaying element is achieved, which results in a good synchronization of the pivotal movements of the pairs of pinching elements, which are in the pinching position at the same moment.

In a preferred embodiment, the delaying element comprises a substantially flat contact surface (49, 65), an edge (53, 69) of said contact surface defining the pivot axis for the pivotal motion into the pinching position.

8 Claims, 6 Drawing Sheets

EPILATING DEVICE WITH PINCHING ELEMENTS HAVING A DELAYING ELEMENT

The invention relates to an epilating device comprising a housing with an opening, a rotatable drive shaft which extends substantially parallel to said opening, at least two cooperating pinching elements which are coupled to the drive shaft in a rotational direction of the drive shaft and which are pivotable with respect to each other by means of a compression member from a catching position, in which a distance is present between the pinching elements near said opening, into a pinching position, in which the pinching elements contact each other near said opening, a delaying element being provided on at least one of the pinching elements for delaying a pivotal motion of the pinching elements relative to each other towards the pinching position.

An epilating device of the kind mentioned in the opening paragraph is known from EP-A-0 532 106. The known epilating device comprises a series of disc-shaped pinching elements, each of which cooperates with each of its two adjacent pinching elements. The compression member comprises two roller members which exert a compression force on the two outermost pinching elements, said compression force being transmitted through the series of pinching elements along an imaginary transmission line extending between the two roller members. During rotation of the drive shaft and the pinching elements, every two adjacent cooperating pinching elements are periodically pivoted with respect to each other under the influence of said compression force about a main pivot axis which is defined by a line through a main stud, which is present on one of the two pinching elements and by means of which the two pinching elements bear on each other, and through a point of contact between the central hubs of the two pinching elements. When the two pinching elements are in the catching position, hair which is present in the opening of the housing can penetrate between the pinching elements. Subsequently, when the main pivot axis of the two pinching elements passes said transmission line, the two pinching elements are pivoted into the pinching position, so that the hairs which have penetrated between the pinching elements are pinched between the pinching elements and are subsequently extracted from the skin as a result of the rotation of the drive shaft and the pinching elements. In the known epilating device, the delaying element is constituted by an additional stud, which is present on one of the two cooperating pinching elements and defines an additional pivot axis together with the main stud. When the two pinching elements are pivoted about the main pivot axis towards the pinching position, the pinching elements are temporarily kept at a reduced distance from each other near the opening of the housing by the additional stud, and the cooperating pinching elements are not further pivoted into the pinching position until the additional pivot axis passes said transmission line upon further rotation of the drive shaft and the pinching elements. As a result of the use of the delaying element, the cooperating pinching elements are kept at a mutual distance near the opening during a relatively long period of time, so that a relatively large number of hairs can be caught between the pinching elements before the pinching elements arrive into the pinching position.

A drawback of the known epilating device is that pairs of cooperating pinching elements, which are in the pinching position at the same moment, do not reach the pinching position simultaneously as a result of tolerances in the positions of the pinching elements relative to the drive shaft. Since a maximum pinching force between one of said pairs of pinching elements in the pinching position is not reached until the other pairs have also reached the pinching position, hairs present between two cooperating pinching elements in the pinching position can escape from between these pinching elements when the other pairs of pinching elements have not yet reached the pinching position as a result of said tolerances. As a consequence, the efficiency of the known epilating device is adversely affected.

An object of the invention is to provide an epilating device of the kind mentioned in the opening paragraph, in which the pivotal motion of the pairs of pinching elements, which are in the pinching position at the same moment, towards the pinching position is better synchronized, so that the above mentioned drawback of the known epilating device is diminished.

To achieve this object, an epilating device in accordance with the invention is characterized in that the delaying element comprises at least a first and a second contact position for the two cooperating pinching elements, which define a pivot axis about which the pinching elements are pivotable with respect to each other, said pivot axis being arranged at a distance from a central point of the pinching element carrying the delaying element and between said central point and a pinching surface of said pinching element, said pivot axis extending substantially perpendicularly to an imaginary line connecting said central point with a central point of said pinching surface. During rotation of the drive shaft and the pinching elements, the two cooperating pinching elements are pivoted with respect to each other about said pivot axis from an intermediate position into the pinching position or from the pinching position back into said intermediate position each time said pivot axis passes the transmission line of the compression force of the compression member. Since the pivot axis is arranged at a distance from the central point of the pinching element between said central point and the pinching surface of the pinching element and extends substantially perpendicular by to said imaginary line, the cooperating pinching elements remain in said intermediate position for a relatively long time during rotation of the drive shaft, so that the pivotal motion of the pinching elements from said intermediate position into the pinching position and the build-up of the maximum pinching force between the two pinching elements take place in a relatively short period of time. Since the pivotal motion of the pinching elements into the pinching position takes place in a relatively short period of time, the differences between the points of time at which the pairs of pinching elements, which are in the pinching position at the same moment, reach the pinching position is considerably reduced, so that the pivotal motion of said pairs of pinching elements into the pinching position is better synchronized.

A particular embodiment of an epilating device in accordance with the invention is characterized in that the delaying element comprises a substantially flat contact surface for the two cooperating pinching elements, said pivot axis being defined by a straight edge of said contact surface. In this particular embodiment of the epilating device in accordance with the invention, a simple and practical construction of the delaying element is obtained in that the first and the second contact point constitute two angular points of said contact surface, the pivot axis being defined by said straight edge which extends between said two angular points.

A further embodiment of an epilating device in accordance with the invention is characterized in that the two cooperating pinching elements comprise two pairs of cooperating pinching surfaces arranged diametrically relative to each other, one of the two cooperating pinching elements comprising a further delaying element for delaying a pivotal motion of the pinching elements with respect to each other towards a further pinching position, said further delaying element comprising at least a third and a fourth contact position for the two cooperating pinching elements, which define a further pivot axis about which the pinching elements are pivotable with respect to each other, said pivot axis and said further pivot axis extending parallel to each other and substantially perpendicularly to said imaginary line and being arranged respectively on both sides of, and at substantially equal distances from, a central point of the pinching elements. In this further embodiment of the epilating device in accordance with the invention, a very effective operation of the epilating device is achieved in that the two cooperating pinching elements are in a pinching position twice during one revolution of the drive shaft. The pivotal motion of the two pinching elements into a first pinching position, in which a first one of the two pairs of pinching surfaces contact each other near the opening, is delayed in a manner described before by means of said delaying element comprising said first and said second contact position, and the pivotal motion of the two pinching elements into a second pinching position, in which a second one of the two pairs of pinching surfaces contact each other near the opening after half a revolution of the drive shaft, is delayed in a similar manner by means of said further delaying element comprising said third and said fourth contact position.

Yet another embodiment of an epilating device in accordance with the invention is characterized in that said contact surface is a first contact surface provided on a first one of the two cooperating pinching elements and that the further delaying element is provided on a second one of the two cooperating pinching elements, said further delaying element comprising a second substantially flat contact surface for cooperation with said first contact surface, said further pivot axis being defined by a straight edge of said second contact surface. In this embodiment of the epilating device in accordance with the invention, a simple and practical construction of the further delaying element is obtained in that the third and the fourth contact point constitute two angular points of said second contact surface, the further pivot axis being defined by said straight edge of the second contact surface which extends between said two angular points.

A particular embodiment of an epilating device in accordance with the invention is characterized in that the pinching elements each comprise, on a side remote from said two pinching surfaces, two further pinching surfaces arranged diametrically relative to each other on a further imaginary line extending substantially perpendicularly to said imaginary line, and a further contact surface arranged between said two further pinching surfaces, said further contact surface having a straight edge extending substantially perpendicularly to said further imaginary line and at a distance from the central point of the relevant pinching element. In this particular embodiment of the epilating device in accordance with the invention, the two pinching elements of each pair of cooperating pinching elements each adjoin a further pinching element which is identical to the two pinching elements but is in a position relative to the drive shaft which is rotated through an angle of 90°. In this manner, the pinching position of a pair of cooperating pinching elements is followed by the pinching position of the two adjacent pairs of cooperating pinching elements upon further rotation of the drive shaft through an angle of 90°, so that the pinching positions of the successive pairs of cooperating pinching elements are regularly distributed viewed in the rotational direction of the drive shaft, and an even and relatively smooth epilating operation of the epilating device is obtained.

A further embodiment of an epilating device in accordance with the invention is characterized in that, viewed in a direction parallel to the drive shaft, the two pinching surfaces of each pinching element are displaced with respect to each other, and the two further pinching surfaces of each pinching element are displaced with respect to each other. Since the two pinching surfaces and also the two further pinching surfaces are displaced with respect to each other, viewed in the direction parallel to the drive shaft, a position near the opening of the housing, in which two cooperating pinching elements are in the pinching position with a first one of the two pairs of cooperating pinching surfaces, is displaced in the direction parallel to the drive shaft with respect to a position near the opening of the housing, in which said pinching elements are in the pinching position with a second one of the two pairs of cooperating pinching surfaces. In this manner, viewed in a direction parallel to the drive shaft, a regular distribution of the pinching positions of the successive pairs of cooperating pinching elements is obtained, so that the hair-catching performance of the epilating device near the opening in the housing is improved.

A still further embodiment of an epilating device in accordance with the invention is characterized in that, on each pinching element, said two pinching surfaces and said first or second contact surface are arranged step-wise relative to each other, and said two further pinching surfaces and said further contact surface are arranged step-wise relative to each other. In this manner, a displacement of the two pinching surfaces with respect to each other in a direction parallel to the drive shaft, and a displacement of the two further pinching surfaces with respect to each other in a direction parallel to the drive shaft are obtained by means of a simple and practical construction of the pinching elements.

Figure 2:
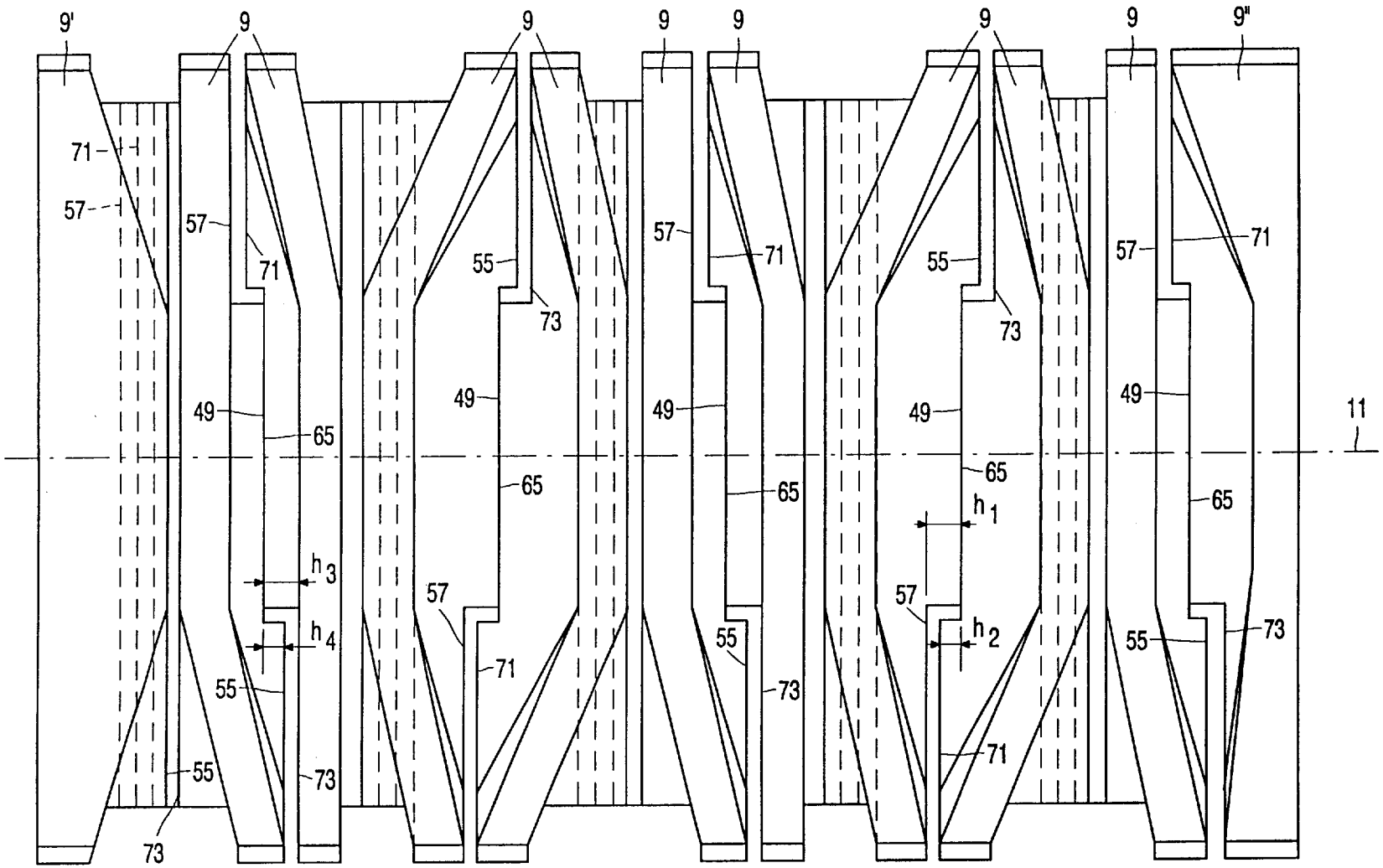
Figure 3:
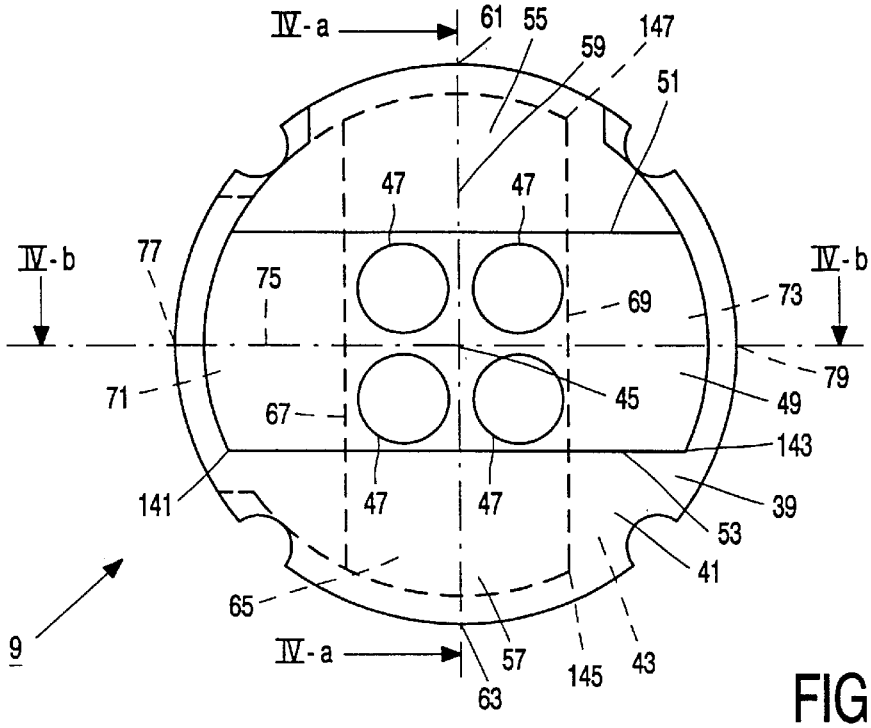
Figure 4A:
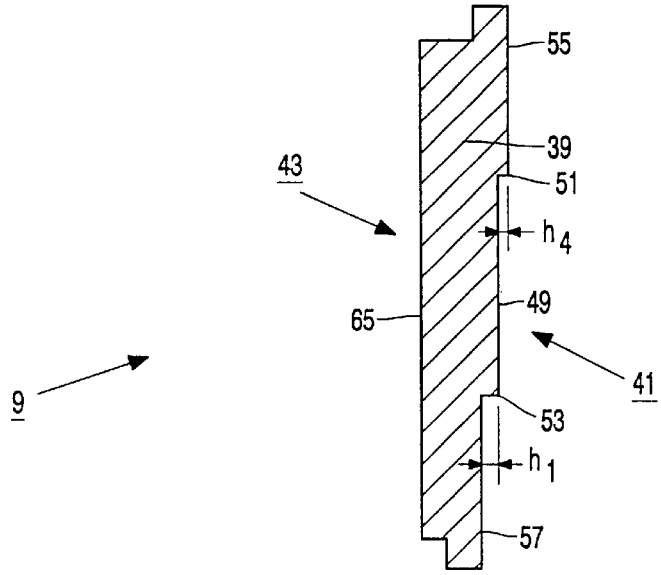
Figure 4B:
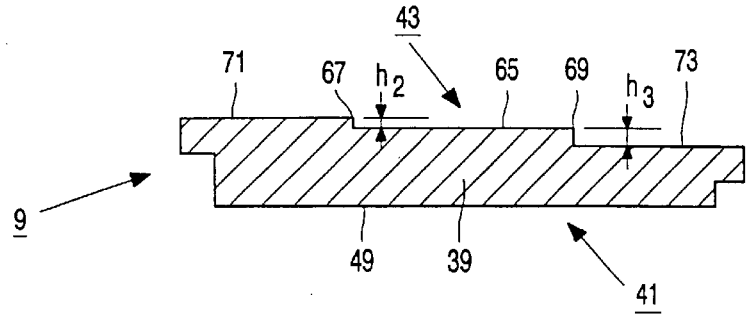
Figure 5:
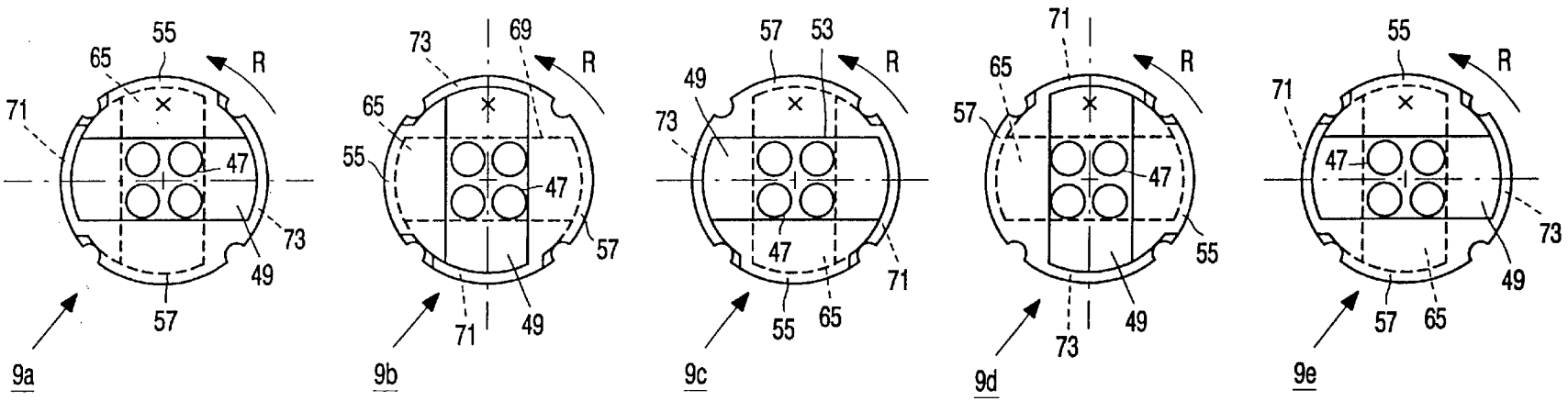

The invention will now be explained in more detail by way of an embodiment and with reference to the drawings, in which FIG. 1 shows an embodiment of an epilating device in accordance with the invention, FIG. 2 shows a series of pinching elements of the epilating device of FIG. 1, FIG. 3 shows a single pinching element of the epilating device of FIG. 1, FIG. 4*a* shows a section taken on the line IVa—IVa in FIG. 3, FIG. 4*b* shows a section taken on the line IVb—IVb in FIG. 3, FIG. 5 shows the positions of five successive pinching elements relative to each other on a drive shaft of the epilating device of FIG. 1, FIGS. 6*a* to 6*d* show the mutual positions of two cooperating pinching elements of the epilating device of FIG. 1 in four successive angular positions of the drive shaft, and FIGS. 7*a* to 7*d* diagrammatically show a number of alternative embodiments of epilating devices according to the invention.

The epilating device according to the invention shown in FIG. 1 comprises a housing 1, which can be held in the user's hand and which comprises an epilation head 3 with an epilation opening 5. A drive shaft 7 carrying a number of disc-shaped pinching elements 9 is present in the epilation head 3. A centreline 11 of the drive shaft 7 extends substantially parallel to the opening 5. The drive shaft 7 comprises four substantially parallel round metal rods 13 which are substantially arranged in a square, seen in a plane perpendicular to the centreline 11. It is noted that only two of the four rods 13 are partially visible in FIG. 1. The two ends of each rod 13 are mounted to a first mounting disc 15 and to a second mounting disc 17, respectively, the mounting discs 15 and 17 being rotatably journalled by means of a first journal 19 in a first bearing bush 21 and by means of a second journal 23 in a second bearing bush 25, respectively. The first mounting disc 15 is provided with a toothed rim 27 which is in engagement with a toothed belt 29. The toothed belt 29 is in engagement with a gear wheel 31 which is fastened to an output shaft 33 of an electric motor 35. The electric motor 35 is fastened to a main frame 37 of the housing 1 and is capable of driving the drive shaft 7 in a rotational direction.

As FIGS. 1 and 2 show, the epilating device comprises a first outermost pinching element 9' adjoining the first mounting disc 15, and a second outermost pitching element 9" adjoining the second mounting disc 17. Between the two outermost pinching elements 9' and 9", nine identical pinching elements 9 are arranged. FIG. 3 shows one of the identical pinching elements 9, seen from a direction parallel to the centreline 11. The pinching element 9 is made from a synthetic material and comprises a disc-shaped plate 39 having a first side 41 and a second side 43. Around a central point 45 of the plate 39, four circular openings 47 are provided in a square, each opening 47 accommodating one of the four rods 13 of the drive shaft 7 with a small tolerance. Said tolerance is such that the pinching element 9 is coupled to the drive shaft 7 in the rotational direction of the drive shaft 7 and that the pinching element 9 can be sufficiently pivoted with respect to the drive shaft 7 in a manner that will be described in the following. On its first side 41, the pinching element 9 is provided with a first substantially flat contact surface 49 having a first straight edge 51 and a second straight edge 53 substantially parallel to the first edge 51, said first edge 51 and said second edge 53 being arranged respectively on both sides of, and at approximately equal distances from, the central point 45 of the plate 39. At its first edge 51, the first contact surface 49 adjoins a first pinching surface 55 of the pinching element 9, and at its second edge 53, the first contact surface 49 adjoins a second pinching surface 57 of the pinching element 9. An imaginary line 59, which connects a central point 61 of the first pinching surface 55 and a central point 63 of the second pinching surface 57, goes through the central point 45 of the plate 39 and extends substantially perpendicularly to the first edge 51 and to the second edge 53 of the first contact surface 49. As shown in FIG. 4*a,* the first pinching surface 55, the first contact surface 49, and the second pinching surface 57 are arranged step-wise with respect to each other on the first side 41. On its second side 43, the pinching element 9 is provided in a similar manner with a second substantially flat contact surface 65 having a first edge 67 and a second edge 69 arranged respectively on both sides of, and at approximately equal distances from, the central point 45 of the plate 39. At its first edge 67, the second contact surface 65 adjoins a third pinching surface 71 of the pinching element 9, and at its second edge 69, the second contact surface 65 adjoins a fourth pinching surface 73 of the pinching element 9. An imaginary line 75, which connects a central point 77 of the third pinching surface 71 with a central point 79 of the fourth pinching surface 73, goes through the central point 45 of the plate 39 and extends substantially perpendicularly to the first edge 67 and to the second edge 69 of the second contact surface 65. As shown in FIG. 4*b,* the third pinching surface 71, the second contact surface 65, and the fourth pinching surface 73 are arranged step-wise with respect to each other on the second side 43. As FIG. 3 shows, the first edge 67 and the second edge 69 of the second contact surface 65 extend substantially perpendicularly to the first edge 51 and the second edge 53 of the first contact surface 49, so that the first contact surface 49 and the second contact surface 65 are rotated with respect to each other about the central point 45 of the plate 39 through an angle of substantially 90°. Likewise, the first pinching surface 55 and the third pinching surface 71, and also the second pinching surface 57 and the fourth pinching surface 73, are rotated with respect to each other about said central point 45 through an angle of substantially 90°.

FIG. 5 shows five successive pinching elements 9*a,* 9*b,* 9*c,* 9*d,* and 9*e* seen from a direction parallel to the centreline 11. As shown, the pinching element 9*b* is arranged on the drive shaft 7 in a position which is rotated with respect to the pinching element 9*a* through an angle of 90° in the rotational direction R. Likewise, the pinching element 9*c* is rotated with respect to the pinching element 9*b* through an angle of 90° in the rotational direction R, the pinching element 9*d* is rotated with respect to the pinching element 9*c* through an angle of 90° in the rotational direction R, and the pinching element 9*a* is rotated with respect to the pinching element 9*d* through an angle of 90° in the rotational direction R. Consequently, the two pinching elements 9*a* are in identical angular positions relative to the drive shaft 7. The other pinching elements 9 of the epilating device are arranged on the drive shaft 7 and operate in a manner similar to the pinching elements 9*a,* 9*b,* 9*c,* 9*d,* and 9*e* shown, i.e. the pinching element 9*a* at the left in FIG. 5 is followed by another pinching element 9*d,* the pinching element 9*e* at the right in FIG. 5 is followed by another pinching element 9*b,* etc. As FIG. 1 shows, the nine pinching elements 9 and the two outermost pinching elements 9' and 9" form a package of cooperating pinching elements which is kept together, seen in a direction parallel to the centreline 11, by a compression member 81 of the epilating device. The compression member 81 comprises a first roller member 83, which is present near the first mounting disc 15 and is journalled relative to the main frame 37 so as to be rotatable about a first axis of rotation 85 extending transversely to the centreline 11, and a second roller member 87, which is present near the second mounting disc 17 and is journalled relative to a pivot arm 89 so as to be rotatable about a second axis of rotation 91 extending transversely to the centreline 11. The pivot arm 89 is pivotable with respect to the main frame 37 about a pivot axis 93 and is urged in a pivotal direction P, shown in FIG. 1, about said pivot axis 93 under the influence of a prestressing force exerted by a mechanical spring member 95 mounted between the main frame 37 and the pivot arm 89. As a result of said prestressing force, the roller members 83 and 87 exert a compressive force F, shown in FIG. 1, on the outermost discs 9' and 9" under the influence of which the package of cooperating pinching elements is kept together in the direction parallel to the centreline 11. Since the identical pinching elements 9 are arranged on the drive shaft 7 in positions which are rotated with respect to each other through an angle of 90°, as described before, the first contact surface 49 of each pinching element 9 is, at the first side 41 of said pinching element 9, in contact with the second contact surface 65 of the adjacent pinching element, and the second contact surface 65 of each pinching element 9 is, at the second side 43 of said pinching element 9, in contact with the first contact surface 49 of the other adjacent pinching element. That is, in FIG. 5, the first contact surface 49 of the pinching element 9*a* contacts the second contact surface 65 of the pinching element 9*b*, the first contact surface 49 of the pinching element 9*b* contacts the second contact surface 65 of the pinching element 9*c*, the first contact surface 49 of the pinching element 9*c* contacts the second contact surface 65 of the pinching element 9*d*, and the first contact surface 49 of the pinching elements 9*d* contacts the second contact surface 65 of the pinching element 9*e*. As a result, the first pinching surface 55 and the second pinching surface 57 of each pinching element 9 respectively face, at the first side 41 of said pinching element 9, the fourth pinching surface 73 and the third pinching surface 71 of the adjacent pinching element, and the third pinching surface 71 and the fourth pinching surface 73 of each pinching element 9 respectively face, at the second side 43 of said pinching element 9, the second pinching surface 57 and the first pinching surface 55 of the other adjacent pinching element. It is noted that the outermost pinching elements 9' and 9" are provided with a contact surface and two pinching surfaces only on the side which faces the adjacent pinching element. On the side remote from the adjacent pinching disc, the outermost pinching elements 9' and 9" are provided with a substantially flat surface 97 for cooperation with the roller members 83 and 87. In FIG. 2, for the sake of simplicity, the package of pinching elements 9, 9', 9" is shown in a position in which each pinching element 9, 9', and 9" extends substantially perpendicularly to the centreline 11 and in which the contact surfaces 49 and 65 of each pair of adjoining pinching elements 9, 9', 9" are in full contact with each other. As shown in this figure, a height $h_1$ of the first contact surfaces 49 above the second pinching surfaces 57 is substantially larger than a height $h_2$ of the third pinching surfaces 71 above the second contact surfaces 65. Likewise, a height $h_3$ of the second contact surfaces 65 above the fourth contact surfaces 73 is substantially larger than a height $h_4$ of the first pinching surfaces 55 above the first contact surfaces 49. As a result, in the situation shown in FIG. 2, a clearance is present between the first pinching surfaces 55 and the fourth pinching surfaces 73 and also between the second pinching surfaces 57 and the third pinching surfaces 71 of the adjacent pinching elements. It is noted that the heights $h_1$, $h_2$, $h_3$, and $h_4$ are also shown in FIGS. 4*a* and 4*b*.

During operation, when the drive shaft 7 is rotated about the centreline 11, the pinching elements 9, 9', 9" cooperate as follows. The compressive force F exerted by the roller members 83, 87 is transmitted through the package of pinching elements 9, 9', 9" along an imaginary transmission line which extends between the two roller members 83, 87 at a side of said package close to the epilation opening 5. In FIG. 5, an imaginary point of intersection between each of the pinching elements 9*a*, 9*b*, 9*c*, 9*d*, 9*e* shown and said imaginary transmission line is indicated by a cross X. In the angular position of the drive shaft 7 shown in FIG. 5, the pinching elements 9*a* and 9*b* are in a pinching position under the influence of the compressive force F, in which position the first contact surface 49 of the pinching element 9*a* contacts the second edge 69 of the second contact surface 65 of the pinching element 9*b* and the first pinching surface 55 of the pinching element 9*a* contacts the fourth pinching surface 73 of the pinching element 9*b* near the epilation opening 5. In said pinching position, which is diagrammatically shown in FIG. 6*a*, the pinching elements 9*a*, 9*b* are in an oblique position relative to each other, said oblique position being possible as a result of the tolerances between the openings 47 and the rods 13. In the same manner, the pinching elements 9*c* and 9*d* are in a pinching position, diagrammatically shown in FIG. 6*c*, under the influence of the compressive force F, in which position the second contact surface 65 of the pinching element 9*d* contacts the second edge 53 of the first contact surface 49 of the pinching element 9*c* and the second pinching surface 57 of the pinching element 9*c* contacts the third pinching surface 71 of the pinching element 9*d* near the epilation opening 5. The pinching elements 9*b* and 9*c* are in a parallel position relative to each other, which is diagrammatically shown in FIG. 6*b*, and in which the first contact surface 49 of the pinching element 9*b* and the second contact surface 65 of the pinching element 9*c* are substantially in full contact with each other. Likewise, the pinching elements 9*d* and 9*e* are in a parallel position relative to each other, which is diagrammatically shown in FIG. 6*d*, in which the first contact surface 49 of the pinching element 9*d* and the second contact surface 65 of the pinching element 9*e* are substantially in full contact with each other.

Figure 6A:
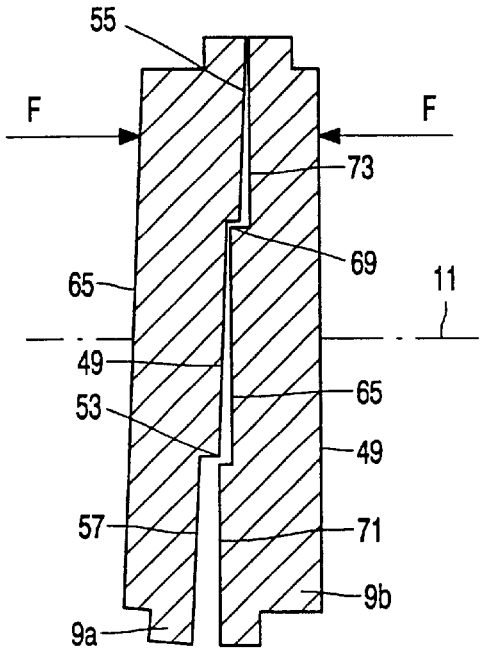
Figure 6B:
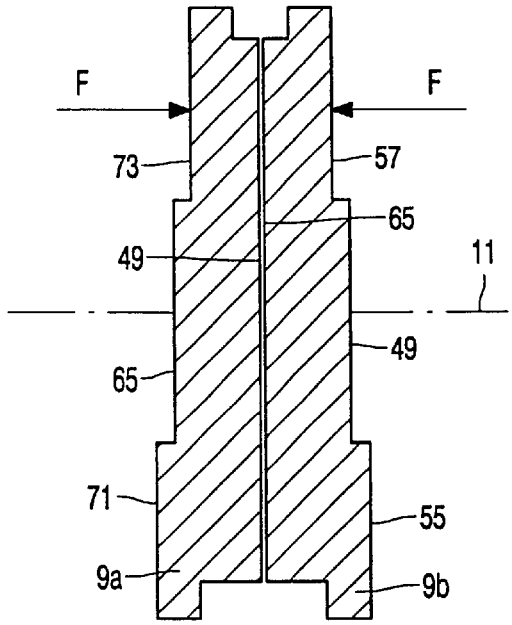

Upon further rotation of the drive shaft 7 in the rotational direction R, when the fourth edge 69 of the second contact surface 65 of the pinching element 9*b* passes the transmission line, the pinching elements 9*a* and 9*b* will be pivoted with respect to each other, under the influence of the compressive force F, about said fourth edge 69 into the parallel position shown in FIG. 6*b*. Subsequently, when the second edge 53 of the first contact surface 49 of the pinching element 9*a* passes the transmission line, the pinching elements 9*a* and 9*b* will be pivoted with respect to each other, under the influence of the compression force F, about said second edge 53 into the pinching position shown in FIG. 6*c*. Subsequently, when said second edge 53 passes the transmission line again, the pinching elements 9*a* and 9*b* will be pivoted with respect to each other, under the influence of the compressive force F, about said second edge 53 again into the parallel position shown in FIG. 6*d*. Finally, when said fourth edge 69 passes the transmission line again, the pinching elements 9*a* and 9*b* will be pivoted with respect to each other, under the influence of the compressive force F, about said fourth edge 69 again into the pinching position shown in FIG. 6*a*, so that the starting position of FIG. 5 is reached again. In this manner, the pinching elements 9*a* and 9*b* constitute a pair of cooperating pinching elements which, during one complete revolution of the drive shaft 7, are pivoted twice from a pinching position into a parallel position and twice from a parallel position into a pinching position under the influence of the compression member 81. In the parallel position shown in FIG. 6*b*, a distance is present between the second pinching surface 57 of the pinching element 9*a* and the third pinching surface 71 of the pinching element 9*b* near the epilation opening 5, so that hairs, which are present in the epilation opening 5 when the epilation head 3 is moved over the skin by the user, can penetrate between said pinching surfaces 57, 71. When the pinching elements 9*a*, 9*b* are subsequently pivoted into the pinching position shown in FIG. 6*c*, said hairs are pinched between said pinching surfaces 57, 71, under the influence of the compression force F, and are extracted from of the skin under the influence of the further rotation of the pinching elements 9*a*, 9*b*. Likewise, in the parallel position shown in FIG. 6*d*, a distance is present between the first pinching surface 55 of the pinching element 9*a* and the fourth pinching surface 73 of the pinching element 9*b* near the epilation opening 5, so that hairs present in the epilation opening 5 can penetrate between said pinching surfaces 55, 73. When the pinching elements 9*a*, 9*b* are subsequently pivoted into the pinching position shown in FIG. 6*a,* said hairs are pinched between said pinching surfaces 55, 73, under the influence of the compression force F, and are pulled out of the skin under the influence of the further rotation of the pinching elements 9*a,* 9*b.* In this manner, the parallel positions of the pinching elements 9*a,* 9*b* shown in FIGS. 6*b* and 6*d* constitute hair catching positions. Since the pinching element 9*a* comprises the first pinching surface 55 and the second pinching surface 57, which are arranged on both sides of the central point 45 for cooperation with, respectively, the fourth pinching surface 73 and the third pinching surface 71 of the pinching element 9*b,* the two cooperating pinching elements 9*a,* 9*b* are in a pinching position twice during one revolution of the drive shaft 7, so that a very effective operation of the epilating device is achieved.

Figure 6C:
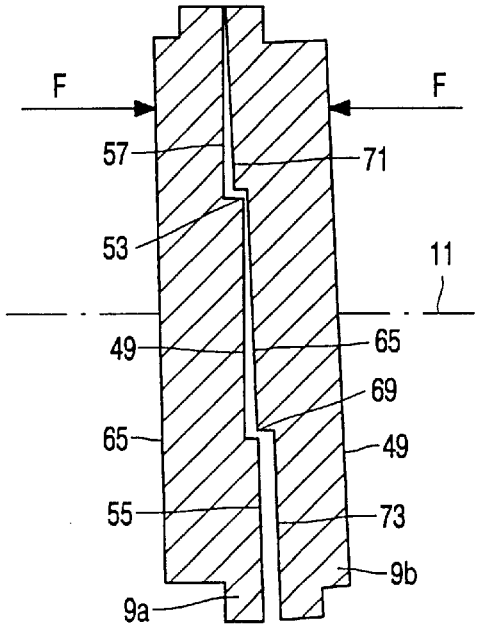
Figure 6D:
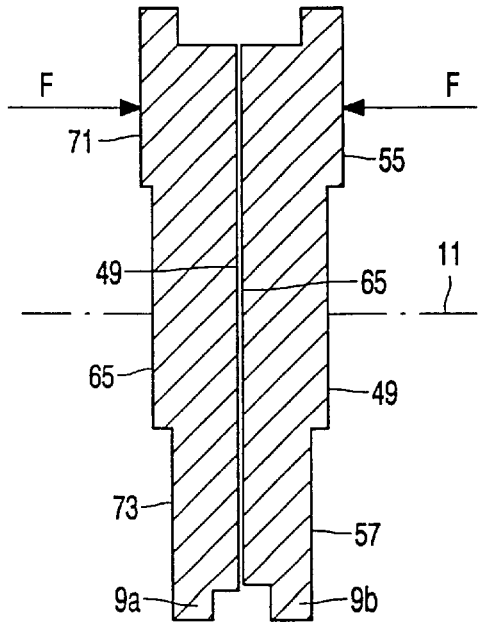

The pinching elements 9*b* and 9*c* in FIG. 5 cooperate in a manner similar to the pinching elements 9*a* and 9*b.* However, since the pinching elements 9*b* and 9*c* are arranged in angular positions on the drive shaft 7, which are rotated through 90° with respect to the pinching elements 9*a* and 9*b,* respectively, the pinching elements 9*b,* 9*c* are in the parallel position of FIG. 6*b* when the pinching elements 9*a,* 9*b* are in the pinching position of FIG. 6*a,* the pinching elements 9*b,* 9*c* are in the pinching position of FIG. 6*c* when the pinching elements 9*a,* 9*b* are in the parallel position of FIG. 6*b,* the pinching elements 9*b,* 9*c* are in the parallel position of FIG. 6*d* when the pinching elements 9*a,* 9*b* are in the pinching position of FIG. 6*c,* and the pinching elements 9*b,* 9*c* are in the pinching position of FIG. 6*a* when the pinching elements 9*a,* 9*b* are in the parallel position of FIG. 6*d.* The pinching elements 9*c* and 9*d,* and the pinching elements 9*d* and 9*e* cooperate correspondingly, similar phase shifts of 90° being present between the cooperation of the pinching elements 9*c,* 9*d* and the cooperation of the pinching elements 9*b,* 9*c* and between the cooperation of the pinching elements 9*d,* 9*e* and the cooperation of the pinching elements 9*c,* 9*d.* In this manner, a pinching position of each pair of cooperating pinching elements is followed by a pinching position of the two adjacent pairs of cooperating pinching elements upon further rotation of the drive shaft 7 through 90°, resulting in a relatively regular distribution of the pinching positions of the successive pairs of cooperating pinching elements, viewed in the rotational direction R of the drive shaft 7, and, consequently, in a relatively even and smooth epilating operation of the epilating device. Since the first pinching surface 55 and the second pinching surface 57 and also the third pinching surface 71 and the fourth pinching surface 73 of each pinching element 9 are arranged step-wise with respect to each other, as described before, it is achieved that, viewed in a direction parallel to the drive shaft 7, the first pinching surface 55 and the second pinching surface 57 and also the third pinching surface 71 and the fourth pinching surface 73 are displaced with respect to each other. Consequently, as shown in FIG. 2, the pinching positions of the cooperating pinching surfaces 57, 71 and the cooperating pinching surfaces 55, 73 of a pair of cooperating pinching elements, and the pinching positions of the cooperating pinching surfaces 57, 71 and the cooperating pinching surfaces 55, 73 of the adjacent pair of cooperating pinching elements are regularly distributed in some degree, viewed in a direction parallel to the centreline 11, resulting in a regular hair-catching performance of the epilating device over the full length of the opening 5.

As described before, the pinching position in which the first pinching surface 55 and the fourth pinching surface 73 of two adjacent cooperating pinching elements 9, 9', 9" contact each other, is reached by a pivotal motion of said pinching elements with respect to each other about the second edge 69 of the second contact surface 65 of one of said pinching elements, and the pinching position, in which the second pinching surface 57 and the third pinching surface 71 of two adjacent cooperating pinching elements 9, 9', 9" contact each other, is reached by a pivotal motion of said pinching elements with respect to each other about the second edge 53 of the first contact surface 49 of the other pinching element. In this manner, the second edge 53 of the first contact surface 49 and the second edge 69 of the second contact surface 65 of a pinching element 9 each define a pivot axis for the pivotal motion of said pinching element 9 into a pinching position with one of its two adjacent pinching elements. In other words, starting from the parallel position shown in FIG. 5, the pinching elements 9*b* and 9*c* do not reach the pinching position until the second edge 53 of the first contact surface 49 of the pinching element 9*b* passes the transmission line. Likewise, the pinching elements 9*d* and 9*a* in FIG. 5 do not reach the pinching position until the second edge 69 of the second contact surface 65 of the pinching element 9*a* passes the transmission line. Accordingly, the angular positions of the drive shaft 7, in which the pivotal motion of the pinching elements 9*b,* 9*c* and the pinching elements 9*d,* 9*a* into the pinching position starts, are determined by the distance between said second edges 53, 69 and the central point 45 of the pinching elements 9. The larger said distance, the later the pivotal motion of the pinching elements 9 into the pinching position starts. Thus, the first contact surface 49 having the second edge 53 and the second contact surface 65 having the second edge 69 act as delaying elements for delaying or postponing the pivotal motion of the pinching elements 9 with respect to each other into the pinching position. Since the second edges 53, 69, which define the pivot axes for the pivotal motions into the pinching positions, extend substantially perpendicularly to the imaginary line 59 and are arranged at a distance from the central point 45, a relatively strong delaying effect is obtained. As a result, in the situation of FIG. 5, the cooperating pinching elements 9*b,* 9*c* and the cooperating pinching elements 9*d,* 9*a* remain in the parallel or hair catching positions for a relatively long time, so that the penetration of hairs between the pinching elements 9*b,* 9*c* and 9*d,* 9*a* can take place for a relatively long time and the hair catching performance of the epilating device is improved.

A further advantage of the delaying action of the contact surfaces 49, 65 is as follows. In the situation shown in FIG. 5, the pairs of pinching elements 9*a,* 9*b* and 9*c,* 9*d* are in the pinching position at the same moment. Upon further rotation of the drive shaft 7 through 90°, the pairs of pinching elements 9*b,* 9*c* and 9*d,* 9*a* will be in the pinching position at the same moment. Since the compressive force of the compression member 81 is transmitted through the package of pinching elements 9, 9', 9" via said transmission line, a maximum pinching force between a first pair of pinching elements 9 in the pinching position is not reached until also the other pairs of pinching elements 9, which are in the pinching position together with said first pair of pinching elements 9, have completely reached the pinching position. Since a tolerance is present between the openings 47 and the rods 13 of the drive shaft 7, the radial positions of the pinching elements 9 relative to the drive shaft 7 are not precisely defined, as a result of which the pairs of pinching elements 9, which are in the pinching position at the same moment, do not reach the pinching position simultaneously. As long as one of these pairs of pinching elements 9 has not completely reached the pinching position, a maximum pinching force between the other pairs of pinching elements 9 is not reached, so that hairs caught between these pairs of pinching elements 9 can still escape from between these pairs of pinching elements 9 upon further rotation of the drive shaft 7. However, as a result of the delaying action of the contact surfaces 49, 65, the pivotal motions of the pairs of pinching elements 9 into the pinching position take place in a relatively short period of time and accordingly are better synchronized. As a result, the build-up of the maximum pinching force between these pairs of pinching elements takes place in a relatively short period of time, so that the above described escape of hairs from between the pinching elements in the pinching position is prevented to a high degree.

In the above-mentioned embodiment of the epilating device according to the invention, each pinching element 9 cooperates with each adjacent pinching element 9 via two pinching surfaces 55, 57 and 71, 73 which are arranged diametrically relative to each other on one of the sides 41 and 43 of the pinching element 9. Accordingly, between each pair of cooperating pinching elements 9, the delaying elements define two pivot axes 53, 69 arranged at both sides of, and at equal distances from, the central point 45 of said pinching elements 9, i.e. one pivot axis 53, 69 for each pair of cooperating pinching surfaces 57, 71 and 55, 73. It is noted, however, that the invention also covers embodiments as diagrammatically shown in FIG. 7*a,* in which each pinching element 101 cooperates with an adjacent pinching element 103 via one pinching surface 105, 107 only. In such embodiments, the delaying element 109 between each pair of cooperating pinching elements 101, 103 defines only one pivot axis 111 arranged between the central point of the pinching element 101, 103 and said pinching surface 105, 107 at a distance from said central point.

In the above-described embodiment of the epilating device according to the invention, two cooperating contact surfaces 49 and 65 are present between each pair of cooperating pinching elements 9, each contact surface 49, 65 defining one pivot axis 53, 69 for delaying the pivotal motion of the pinching elements 9 into the two pinching positions. It is noted, however, that instead of said two contact surfaces 49, 65 a single contact surface 113 having two parallel edges 115, 117 defining the two pivot axes, as diagrammatically shown in FIG. 7*b,* may, for example, alternatively be used on one of the two cooperating pinching elements 119, 121 only.

Figure 7A:
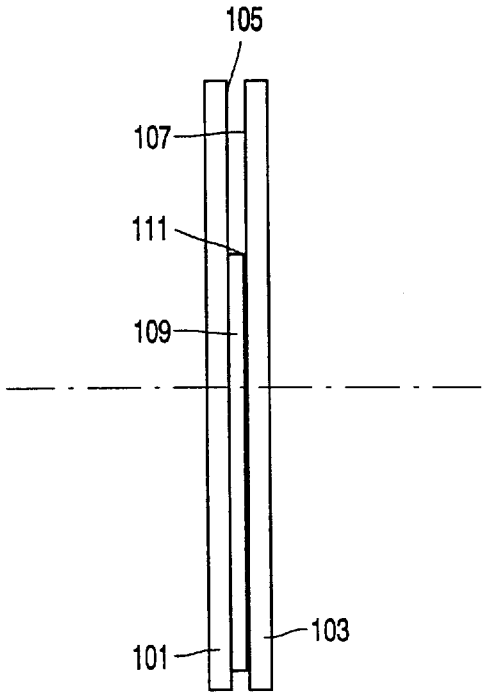
Figure 7B:
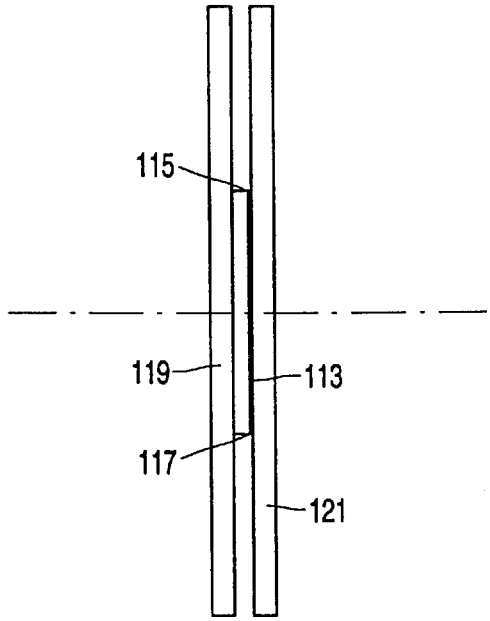
Figure 7C:
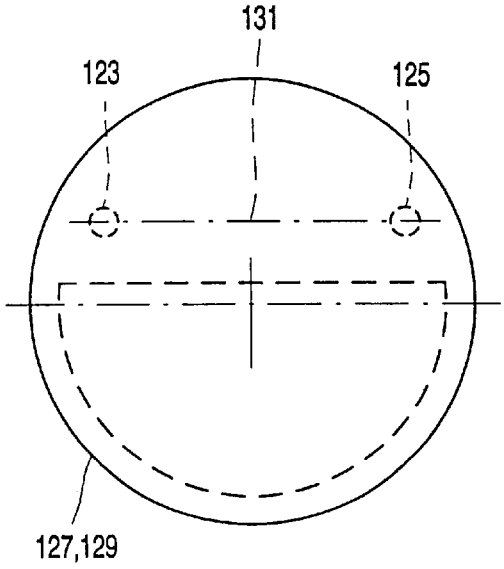
Figure 7D:
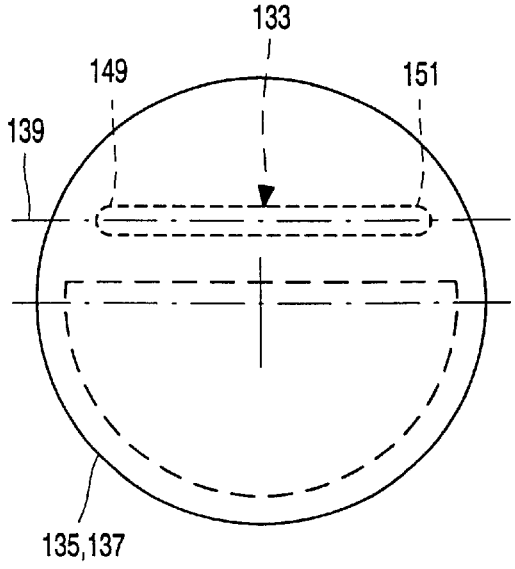

It is finally noted that the invention also covers embodiments in which the delaying element is constructed in another way. As diagrammatically shown in FIG. 7*c,* the delaying element may, for example, comprise two studs 123, 125 provided on one of the cooperating pinching elements 127, 129 and defining a pivot axis 131 extending through the end portions of these studs 123, 125. Alternatively, as diagrammatically shown in FIG. 7*d,* the delaying element may comprise, for example, an elongate ridge 133 provided on one of the cooperating pinching elements 135, 137 and defining a pivot axis 139. In all these embodiments, the delaying element comprises at least a first and a second contact position for the two cooperating pinching elements, which define the pivot axis. In the embodiment of FIG. 3, for example, said at least first and second contact positions are constituted by the two angular points 141 and 143 of the second edge 53 and the two angular points 145 and 147 of the second edge 69. In the embodiment of FIG. 7*c,* said at least first and second contact positions are constituted by the end portions of the two studs 123, 125, and in the embodiment of FIG. 7*d,* said at least first and second contact positions are constituted by the two end portions 149, 151 of the elongate ridge 133. The invention also covers embodiments, in which the delaying element comprises a first portion provided on one of the pinching elements and a second portion provided on the other pinching element. Thus, for example, the stud 123 in FIG. 7*c* may be provided on the pinching element 127 and the stud 125 may be provided on the pinching element 129. In FIG. 7*d,* for example, the ridge 133 may be divided into two equal portions, one of these portions being provided on the pinching element 135 and the other portion being provided on the pinching element 137.

What is claimed is:

1. An epilating device comprising a housing with an opening, a rotatable drive shaft which extends substantially parallel to said opening, at least two cooperating pinching elements which are coupled to the drive shaft in a rotational direction of the drive shaft and which are pivotable with respect to each other by means of a compression member from a catching position, in which a distance is present between the pinching elements near said opening, into a pinching position, in which the pinching elements contact each other near said opening, a delaying element being provided on at least one of the pinching elements for delaying a pivotal motion of the pinching elements relative to each other towards the pinching position, wherein the delaying element comprises at least a first and a second contact position for the two cooperating pinching elements, which define a pivot axis about which the pinching elements are pivotable with respect to each other, said pivot axis being arranged at a distance from a central point of the pinching element carrying the delaying element and between said central point and a pinching surface of said pinching element, said pivot axis extending substantially perpendicularly to an imaginary line connecting said central point with a central point of said pinching surface.

2. An epilating device as claimed in claim 1, wherein the delaying element comprises a substantially flat contact surface for the two cooperating pinching elements, said pivot axis being defined by a straight edge of said contact surface.

3. An epilating device as claimed in claim 1, wherein the two cooperating pinching elements comprise two pairs of cooperating pinching surfaces arranged diametrically relative to each other, one of the two cooperating pinching elements comprising a further delaying element for delaying a pivotal motion of the pinching elements with respect to each other towards a further pinching position, said further delaying element comprising at least a third and a fourth contact position for the two cooperating pinching elements, which define a further pivot axis about which the pinching elements are pivotable with respect to each other, said pivot axis and said further pivot axis extending parallel to each other and substantially perpendicularly to said imaginary line and being arranged respectively on both sides of, and at substantially equal distances from, a central point of the pinching elements.

4. An epilating device as claimed in claim 2, wherein said contact surface is a first contact surface provided on a first one of the two cooperating pinching elements, and the further delaying element is provided on a second one of the two cooperating pinching elements, said further delaying element comprising a second substantially flat contact surface for cooperation with said first contact surface, said further pivot axis being defined by a straight edge of said second contact surface.

5. An epilating device as claimed in claim 4, wherein the pinching elements each comprise, on a side remote from said two pinching surfaces, two further pinching surfaces arranged diametrically relative to each other on a further imaginary line extending substantially perpendicularly to said imaginary line, and a further contact surface arranged between said two further pinching surfaces, said further contact surface having a straight edge extending substantially perpendicularly to said further imaginary line and at a distance from the central point of the relevant pinching element.

6. An epilating device as claimed in claim 3, wherein, viewed in a direction parallel to the drive shaft, the two pinching surfaces of each pinching element are displaced with respect to each other, and the two further pinching surfaces of each pinching element are displaced with respect to each other.

7. An epilating device as claimed in claim 6, wherein, on each pinching element, said two pinching surfaces and said first or second contact surface are arranged step-wise relative to each other, and said two further pinching surfaces and said further contact surface are arranged step-wise relative to each other.

8. An epilating device as claimed in claim 3, wherein said contact surface is a first contact surface provided on a first one of the two cooperating pinching elements, and the further delaying element is provided on a second one of the two cooperating pinching elements, said further delaying element comprising a second substantially flat contact surface for cooperation with said first contact surface, said further pivot axis being defined by a straight edge of said second contact surface.

* * * * *